US007176416B2

(12) United States Patent
Lammerskitten et al.

(10) Patent No.: US 7,176,416 B2
(45) Date of Patent: Feb. 13, 2007

(54) SWITCHING DEVICE FOR CONTROLLING AN INDUSTRIAL COOKING APPARATUS

(75) Inventors: Rainer Lammerskitten, Eglfing (DE); Hannes Wild, Riegsee (DE)

(73) Assignee: Convotherm Elektrogeraete GmbH, Eglfing (DE)

( * ) Notice: Subject to any disclaimer, the term of this patent is extended or adjusted under 35 U.S.C. 154(b) by 13 days.

(21) Appl. No.: 11/054,753

(22) Filed: Feb. 10, 2005

(65) Prior Publication Data

US 2005/0194370 A1 Sep. 8, 2005

(30) Foreign Application Priority Data

Feb. 13, 2004 (DE) ..... 10 2004 007 235

(51) Int. Cl.

| | |
|---|---|
| ***A21B 3/02*** | (2006.01) |
| ***F27D 21/00*** | (2006.01) |
| ***F24C 15/36*** | (2006.01) |
| ***F23M 7/00*** | (2006.01) |

(52) U.S. Cl. ..... 219/413; 219/385; 219/391; 219/507; 99/337; 126/197

(58) Field of Classification Search ..... None
See application file for complete search history.

(56) References Cited

U.S. PATENT DOCUMENTS

| | | | | |
|---|---|---|---|---|
| 3,627,959 | A * | 12/1971 | Chapell | 200/61.62 |
| 4,995,313 | A * | 2/1991 | Delau et al. | 99/467 |
| 5,293,020 | A * | 3/1994 | Han et al. | 219/724 |
| 5,813,711 | A | 9/1998 | Sauvagnat et al. | |
| 2005/0274712 | A1* | 12/2005 | Gagas et al. | 219/494 |

FOREIGN PATENT DOCUMENTS

| | | |
|---|---|---|
| DE | 38 38 917 A1 | 5/1990 |
| DE | 199 14 568 C2 | 10/2003 |

* cited by examiner

*Primary Examiner*—Joseph Pelham
(74) *Attorney, Agent, or Firm*—Ohlandt, Greeley, Ruggiero & Perle, L.L.P.

(57) ABSTRACT

A switching device for controlling an industrial cooking apparatus having a cooking chamber that can be closed by means of a door having a movable door handle with a movable door latch attached to it, with a switch fixed to the housing and with a magnet for actuating the switch, the magnets being arranged in the movable door latch at a position that is positioned adjacent to the switch in a latched state of the door.

4 Claims, 1 Drawing Sheet

SWITCHING DEVICE FOR CONTROLLING AN INDUSTRIAL COOKING APPARATUS

FIELD OF THE INVENTION

The present invention relates to a switching device for controlling an industrial cooking apparatus.

DISCUSSION OF THE BACKGROUND ART

Industrial cooking apparatuses, especially hot-air steamers, are provided with an apparatus control for all components to be controlled, such as the fan and the heating device in particular. For this purpose, it has to be ensured that when the door is opened into a pressure release position, in which only a small gap is left open between the door and the housing of the apparatus for the purpose of pressure compensation, or when the door is opened completely the control switches off especially the fan and the heating device immediately as otherwise the operating staff might sustain burns and/or scalds.

For this purpose, switching devices are known which consist of a contact and a magnet actuating this contact in the door of the cooking chamber. However, tests carried out within the context of the invention have shown that in particular when banging the door shut short contacting of the switch occurs, which actuates in particular the fan or the ventilator, respectively, and the heating device for a short time. The main reason for this is that, by banging the door shut, the door closes the electrical contact for a short time and thus undesired contacting occurs, which leads to the undesired actuation of the fan or the ventilator, respectively, explained above.

SUMMARY OF THE INVENTION

A switching device which ensures that, in particular, the ventilator and the heating device of a cooking apparatus are switched off when the door is in the pressure release position of the cooking chamber and on the other hand enables undesired contacting to be avoided.

Since the magnet for actuating the switch, which is (preferably permanently) fixed to the housing, is arranged in the movable door latch of the door handle, the possibility arises to use the fact that the latched position of the door results in an exactly defined positioning of the latch. This fact is used by the invention, since the magnet is arranged in the movable door latch in such a way that when the door is in the latched condition the magnet is positioned adjacent to the switch, which is fixed to the housing, in such a way that in this position a contacting of the switching device and thus an actuation of the control device is reliably achieved, whereas in any other position of the door and thus of the door latch such contacting can reliably be avoided. The contacting thus does not depend on the distance of the door to the housing, as is the case in the state of the art, but depends on the position of a closing element, in particular in the form of a latch.

BRIEF DESCRIPTION OF THE DRAWINGS

Further details, features and advantages of this invention result from the following description of an embodiment using the drawings in which.

DETAILED DESCRIPTION OF THE PREFERRED EMBODIMENT

Figure 1:
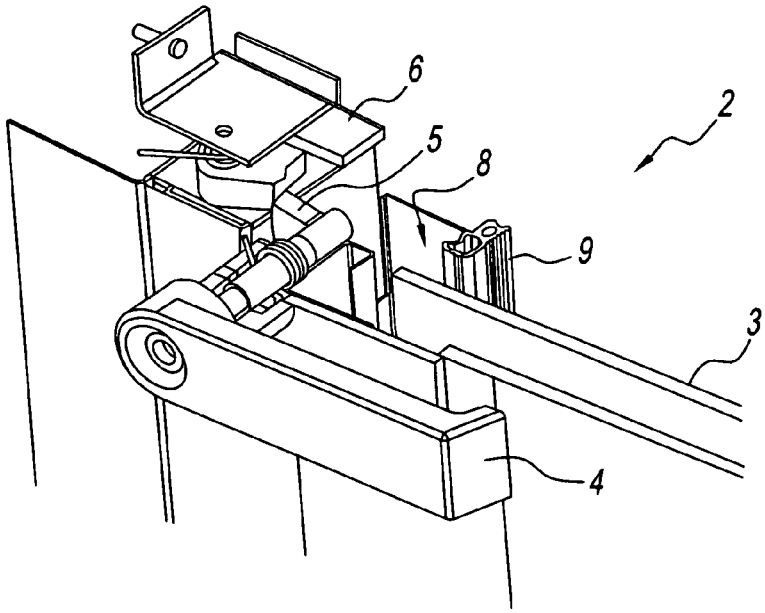
FIG. 1 shows a schematically slightly simplified representation of an inventive switching device in a pressure release position of the door of an industrial cooking apparatus.
Figure 2:
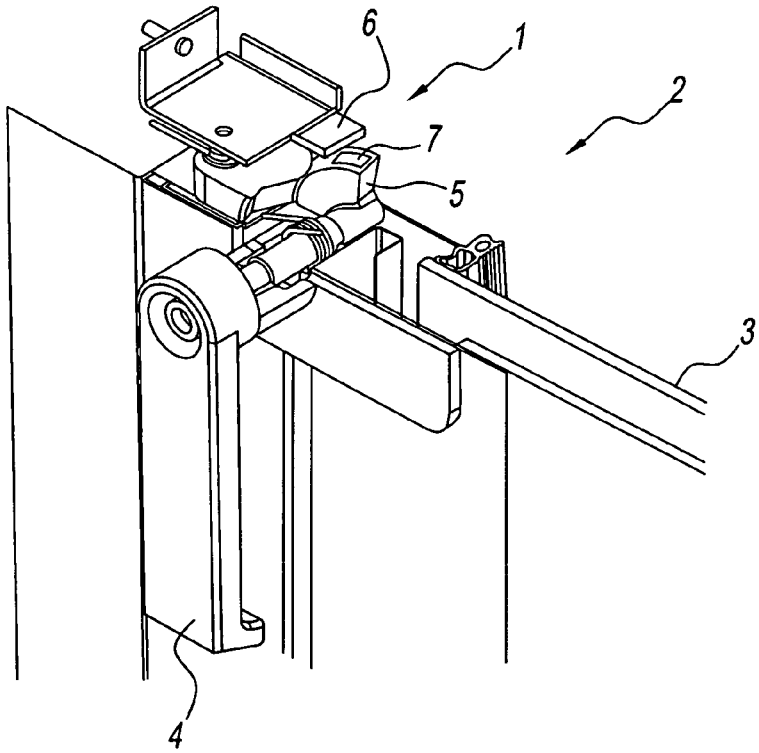
FIG. 2 shows a position corresponding to the one in FIG. 1 in completely closed position of the door of the cooking apparatus.

Taking FIGS. 1 and 2 together, a switching device 1 is known for controlling an industrial cooking device 2 having a cooking chamber not represented in greater detail. The cooking chamber has a door 3 that can be moved between an open-position not shown in the figures, a pressure release position shown in FIG. 1 with a gap 8 between a seal 9 and door 3, and a closing position shown in FIG. 2. For this purpose, door 3 is provided with a door handle 4 equipped with a door latch 5 movable in accordance with its movement. Door latch 5 interacts with a mechanism to achieve the various positions of door 3 explained above.

FIGS. 1 and 2 illustrate the arrangement of a switch 6 fixed to the housing which may be formed as a reed switch, for example. This switch 6 is represented schematically simplified in FIGS. 1 and 2 and is fixed to a suitable part of the housing of cooking apparatus 2.

FIG. 2 illustrates that a magnet 7, preferably in the form of a permanent magnet, is integrated in movable door latch 5. Since door latch 5 is movable between the various positions of door 3 and thus takes various positions relative to switch 6, according to the invention it is possible to ensure both contacting and avoidance of contacting.

In this context, FIG. 1 shows that when door handle 4 is moved into the pressure release position shown in this figure door latch 5 with its integrated magnet 7 is swung away from switch 6, so that in this position, even if door 3 is banged shut violently, contacting and thus an actuation of switching device 1 is reliably avoided due to the resulting distance between switch 6 and magnet 7.

However, in the closing position of door 3 shown in FIG. 2 latch 5 takes an exactly defined position fixed by door handle 4, in which also magnet 7 takes an exactly defined position relative to switch 6. According to the invention, the positioning of magnet 7 within door latch 5 is carried out in such a way that only in this position the distance between switch 6 and magnet 7 is so small that switching device 1 can be actuated by interaction of switch 6 and magnet 7.

As soon as magnet 7 leaves this position shown in FIG. 2 by actuating door handle 4, switching device 1 cannot be actuated, so that undesired contacting in any other position of door 3 can reliably be avoided.

LIST OF REFERENCE NUMERALS 1 switching device
2 cooking apparatus
3 door
4 door handle
5 door latch
6 switch
7 magnet
8 gap
9 seal

The invention claimed is:

1. A switching device for controlling an industrial cooking apparatus having a cooking chamber that can be closed by means of a door having a movable door handle with a movable door latch attached to it, comprising:

a switch fixed to the housing; and a magnet for actuating the switch, wherein the magnet is arranged in the movable door latch at a position that is positioned adjacent to the switch in a latched state of the door.

2. The switching device according to claim 1, wherein the magnet is formed as permanent magnet.

3. The switching device according to claim 1, wherein the switch is a reed switch.

4. An industrial cooking apparatus comprising:

a cooking chamber being adapted to be closed by means of a door having a movable door handle with a movable door latch attached thereto;

a control means; and a switching device for the actuation of said control means, said switching device including a switch fixed to a housing of said cooking chamber and a magnet for actuating the switch, wherein said magnet is arranged in the movable door latch at a position adjacent to the switch in a latched state of the door such that in said position the switching device is adapted to be operated, thereby actuating the control means.

* * * * *